US007237762B2

(12) United States Patent
Wang

(10) Patent No.: US 7,237,762 B2
(45) Date of Patent: Jul. 3, 2007

(54) LIFTING MECHANISM AND SPACER BLOCK ARRANGEMENT FOR LIFTING JACK

(75) Inventor: Chin Hui Wang, Chia-I (TW)

(73) Assignee: Shinn Fu Corporation, Taoyuan (TW)

( * ) Notice: Subject to any disclaimer, the term of this patent is extended or adjusted under 35 U.S.C. 154(b) by 142 days.

(21) Appl. No.: 10/914,145

(22) Filed: Aug. 10, 2004

(65) Prior Publication Data

US 2006/0033089 A1 Feb. 16, 2006

(51) Int. Cl.
*B66F 3/24* (2006.01)

(52) U.S. Cl. ..... 254/93 H; 254/DIG. 1

(58) Field of Classification Search ..... 254/DIG. 1, 254/88, 93 H, 98 R, 100, 133 A, 134; 269/276; 248/188.2, 188.8, 352; 446/92, 125, 117, 446/124

See application file for complete search history.

(56) References Cited

U.S. PATENT DOCUMENTS

| | | | | |
|---|---|---|---|---|
| 396,321 | A * | 1/1889 | Baird | 254/134 |
| 1,337,065 | A * | 4/1920 | Garcia | 254/DIG. 1 |
| 1,521,764 | A * | 1/1925 | Graver | 254/DIG. 1 |
| 2,666,352 | A * | 1/1954 | Philips | 269/276 |
| 2,933,850 | A * | 4/1960 | Martin | 248/188.2 |
| 4,026,086 | A * | 5/1977 | Langley | 52/592.6 |
| 6,027,102 | A * | 2/2000 | Krupa | 254/134 |

* cited by examiner

*Primary Examiner*—Robert C. Watson
(74) *Attorney, Agent, or Firm*—Lathrop & Gage LC

(57) ABSTRACT

A lifting mechanism and spacer block arrangement is disclosed to include a magnetically attractive lifting mechanism installed in a lifting jack and driven to move a lifting rod vertically, and a plurality of magnetically attractive spacer blocks for attaching to the lifting mechanism at the bottom in a stack to space the lifting mechanism above the floor, each spacer block having a top side mounted with a magnet in a flush manner, and a bottom side fitting the top side for enabling the spacer blocks to be arranged in a stack and secured to the bottom side of the lifting mechanism.

32 Claims, 6 Drawing Sheets

LIFTING MECHANISM AND SPACER BLOCK ARRANGEMENT FOR LIFTING JACK

BACKGROUND OF THE INVENTION (a) Field of the Invention

The present invention relates generally to a lifting jack and more particularly, to a lifting mechanism and spacer block arrangement for use in a hydraulic/air lifting jack.

(b) Description of the Prior Art

When wishing to lift a load, for example, a machine, lathe, construction, etc., or to support a first member on a second member at the desired pitch, a small hydraulic/air lifting jack may be used. A small hydraulic/air lifting jack is highly movable, however it has a limited lifting stroke. When lifting a load, the user may have to operate the hydraulic/air lifting jack to lift the load to the desired elevation through several lifting stokes. Further, after each lifting stroke during a lifting operation, a respective movable support block is used to support the load in position and a spacer block is inserted under the lifting mechanism of the hydraulic/air lifting jack so that the lifting mechanism of the hydraulic/air lifting jack can be operated to lift the load again. If the spacer block in use can not be positively maintained in position, the load and the lifting mechanism may fall, thereby resulting in an accident.

SUMMARY OF THE INVENTION

The present invention has been accomplished under the circumstances in view. According to one aspect of the present invention, the lifting mechanism and spacer block arrangement comprises a lifting mechanism installed in a lifting jack and driven to move a lifting rod vertically, and a plurality of spacer blocks for attaching to the bottom side of said lifting mechanism to space said lifting mechanism above the floor or work place. According to another aspect of the present invention, the lifting mechanism and the spacer blocks are respectively made of a magnetically attractive material; each spacer block has a top side fitting the bottom side of the lifting mechanism, a magnet fixedly mounted in the top side in a flush manner, and a bottom side fitting the top side for enabling the spacer blocks to be arranged in a stack and secured to the bottom side of the lifting mechanism positively.

DETAILED DESCRIPTION OF THE PREFERRED EMBODIMENTS

Figure 1:
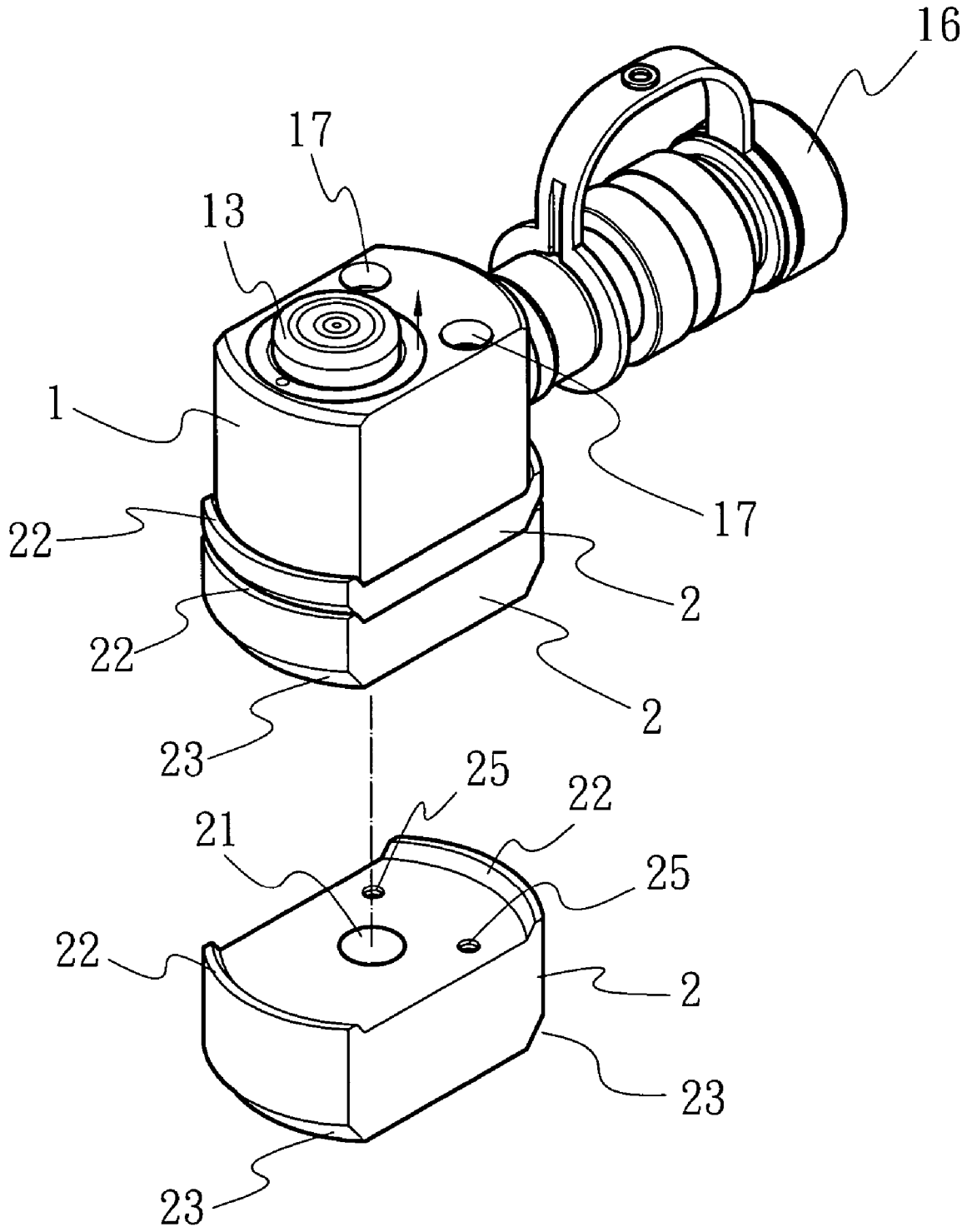
FIG. 1 is an exploded view of a lifting mechanism and spacer arrangement according to the present invention.
Figure 2:
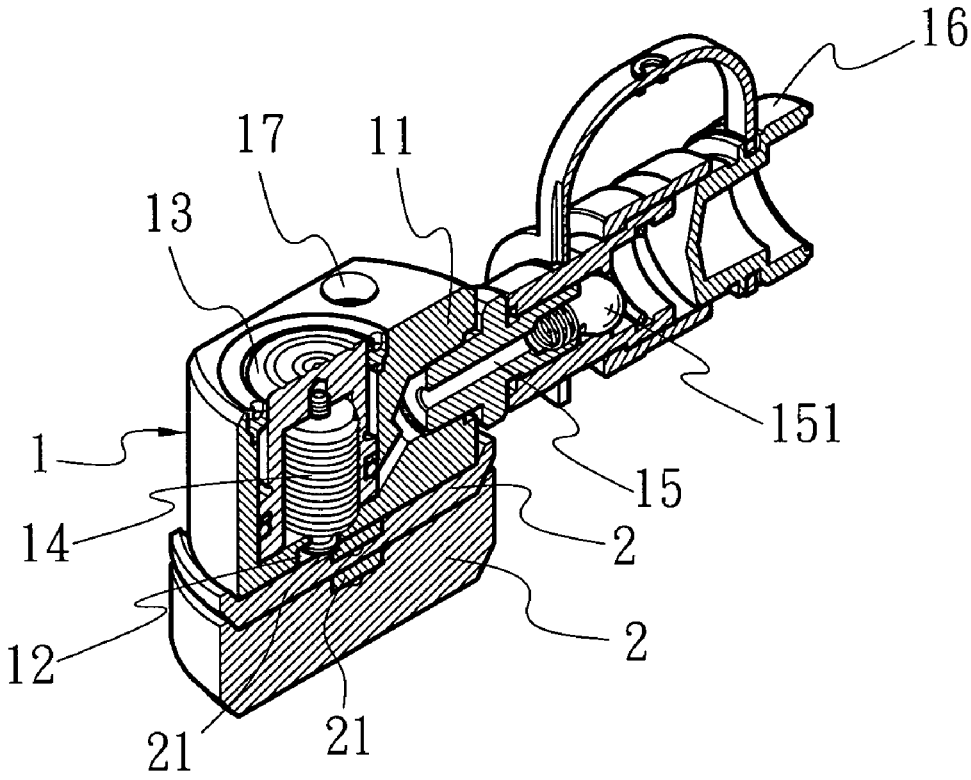
FIG. 2 is a sectional elevation of the lifting mechanism and spacer arrangement according to the present invention.

Referring to FIGS. 1 and 2, a lifting mechanism and spacer arrangement in accordance with the present invention is shown comprising a lifting mechanism 1 and a plurality of metal spacer blocks 2.

The lifting mechanism 1 comprises a magnetically attractive casing 11, which defines therein an oil chamber 12 and an oil inlet 15 in communication with the oil chamber 12, a lifting rod 13 mounted in the casing 11 and vertically movable in and out of the top side of the casing 11, a return spring 14 mounted inside the lifting rod 13 within the casing 11 and adapted to retract the lifting rod 13 after a lifting operation, a one-way valve 151 installed in the oil inlet 15, and a cover 16 for closing the oil inlet 15. When in use, the cover 16 is removed from the oil inlet 15, and then a hydraulic fluid is guided through the oil inlet 15 and the one-way valve 151 into the oil chamber 12 to lift the lifting rod 13 and the load at the lifting rod 13. After release of hydraulic fluid from the oil chamber 12, the return spring 14 immediately pulls the lifting rod 13 back to the inside of the casing 11. The lifting mechanism 1 can also be used in an air lifting jack so that compressed air can be supplied to the oil chamber 12 to lift the lifting rod 13.

Figure 3:
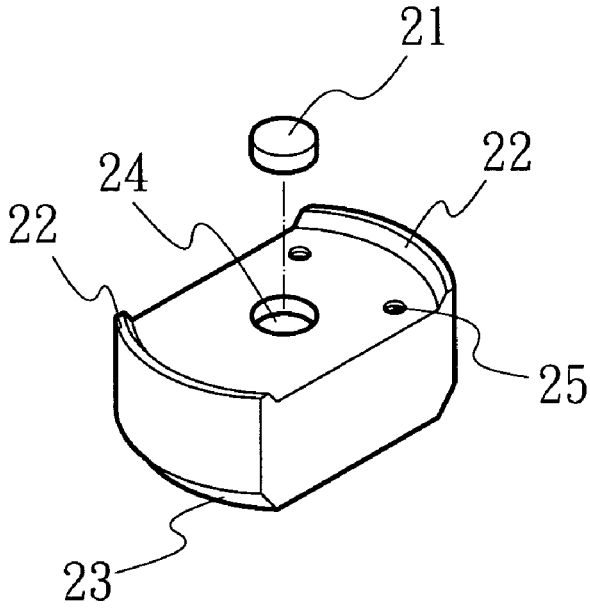
FIG. 3 is an elevational view of one spacer block according to the present invention.
Figure 4:
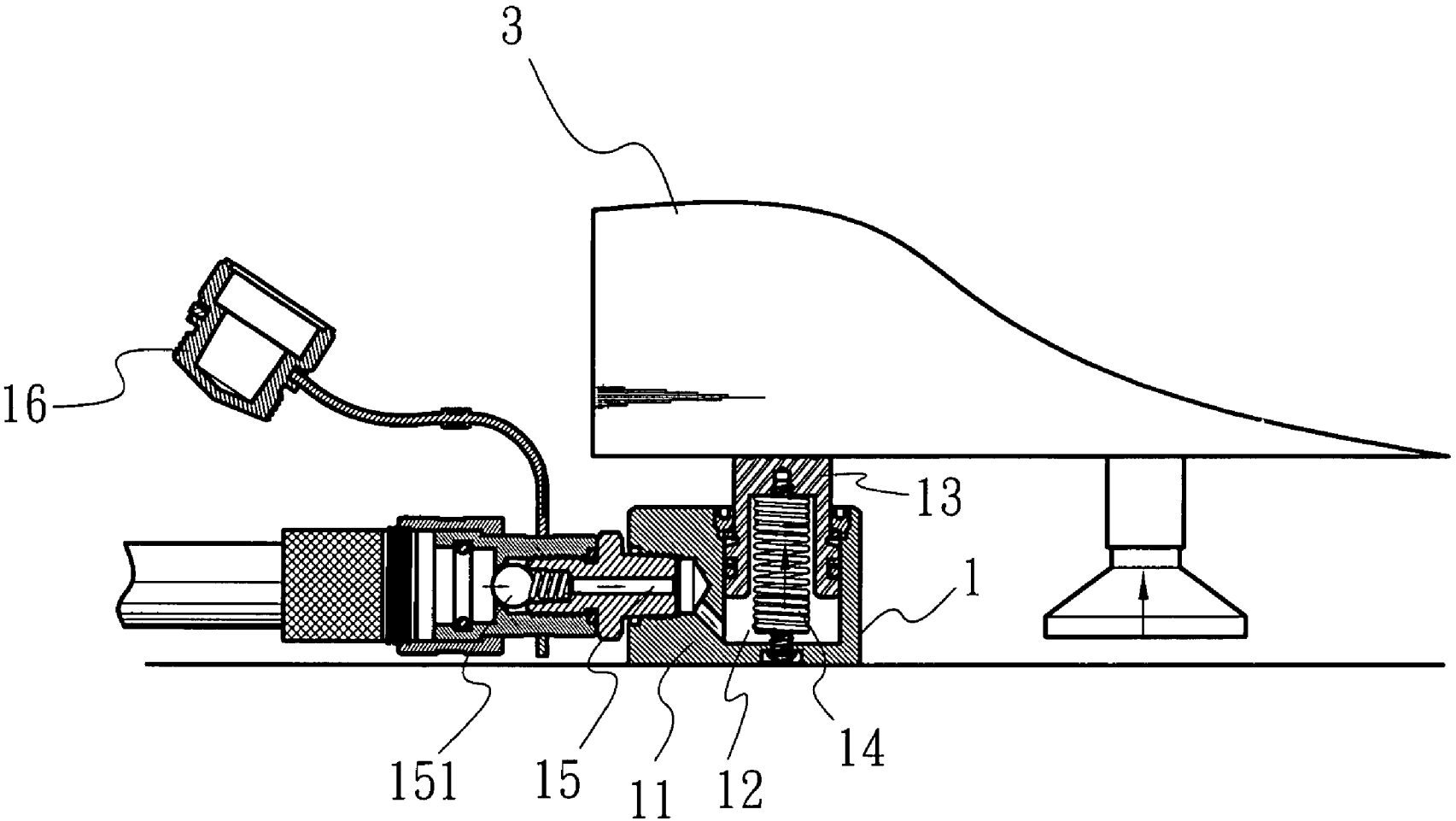
FIG. 4 is a sectional view showing the use of the present invention.

Referring to FIG. 3, a spacer block 2 in accordance with the present invention is a magnetically attractive metal block member having a top hole 24 at the center of the top wall, a magnet 21 affixed to the top hole 24, two upright top flanges 22 at two sides of the top wall, and a chamfered bottom side 23.

Referring to FIG. 4 and FIGS. 1~3 again, by means of inserting the chamfered bottom side 23 of one spacer block 2 into the space between the two upright top flanges 22 of another spacer block 2, a number of spacer blocks 2 are arranged in a stack and firmly secured together by means of magnetic attraction. Further, by means of the magnet 21, one spacer block 2 can positively be secured to the bottom side of the casing 11.

Figure 5:
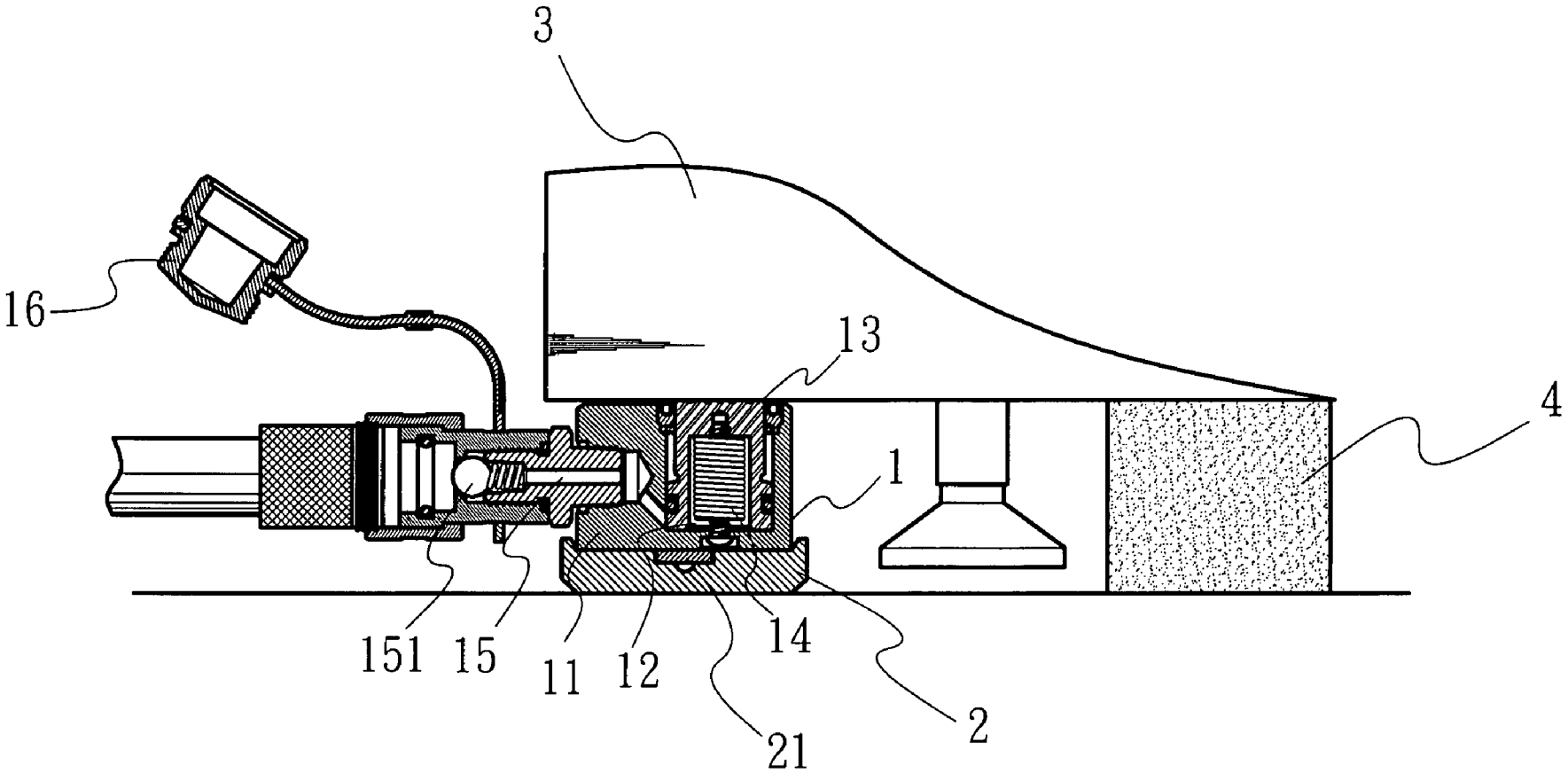
FIG. 5 is a sectional view showing the continued use of the present invention.
Figure 6:
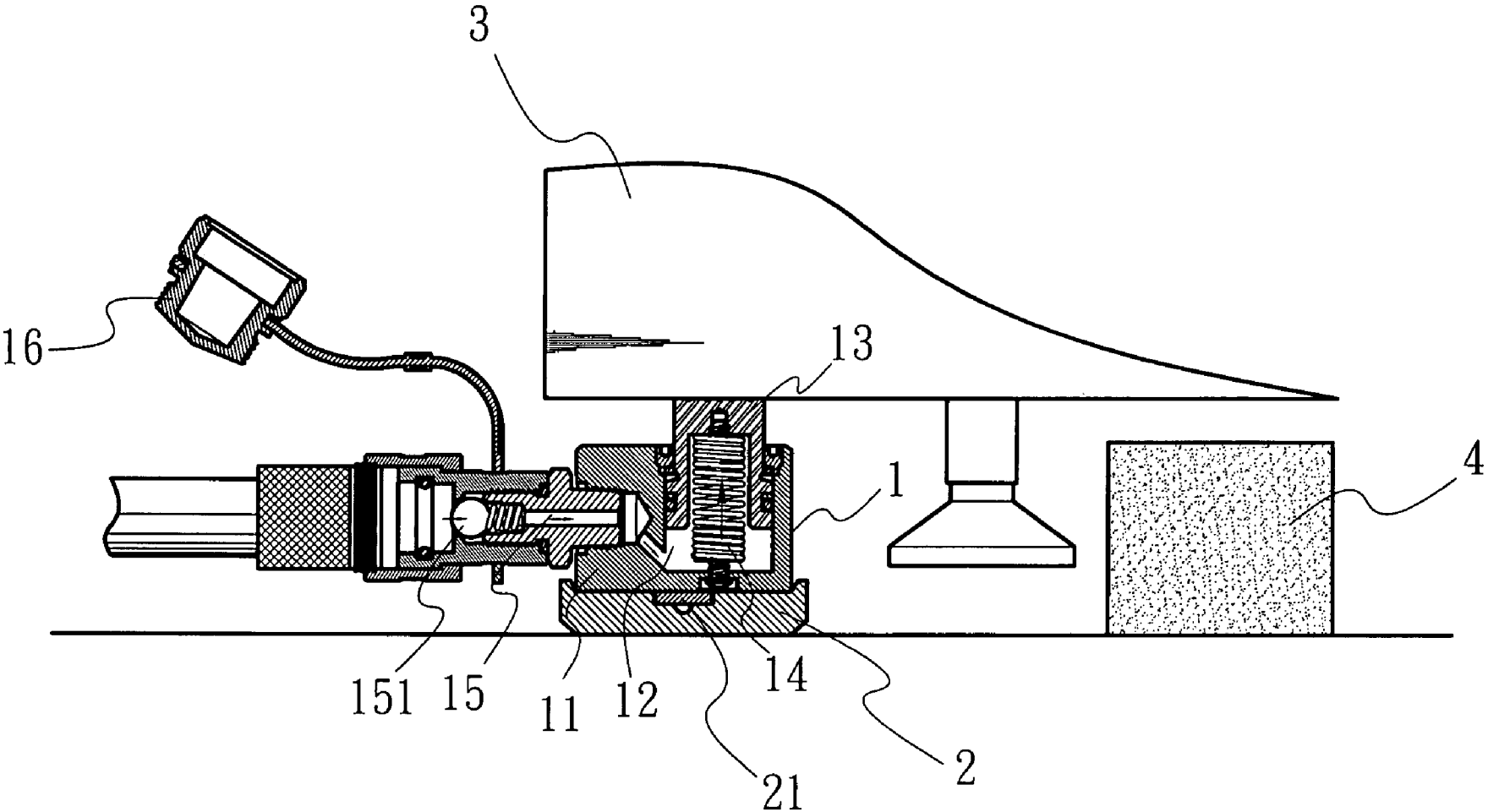
FIG. 6 is a sectional view showing the continued use of the present invention.
Figure 7:
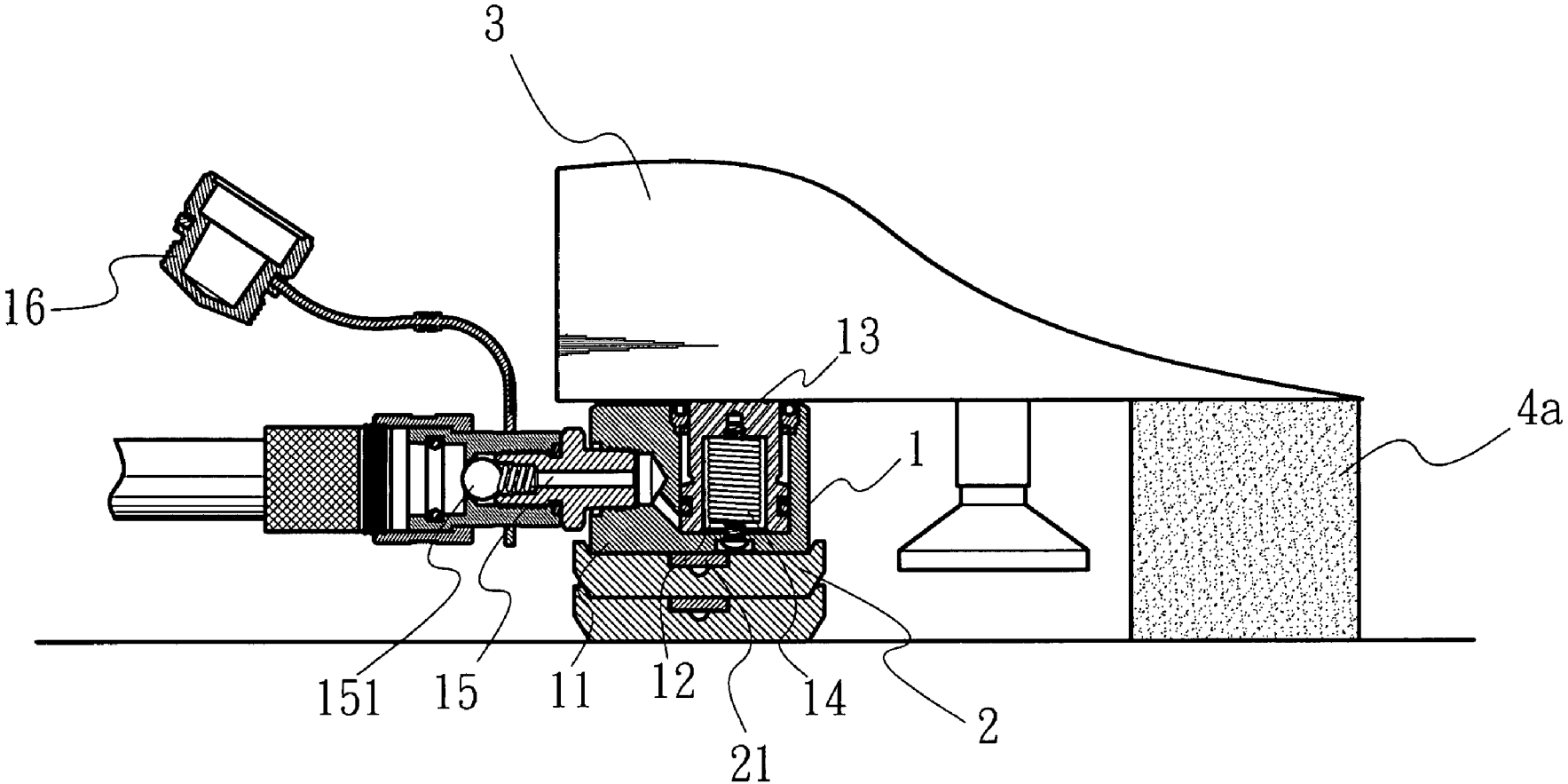
FIG. 7 is a sectional view showing the continued use of the present invention.

Referring to FIGS. 5~7, after one lifting stroke, a first movable support 4 is inserted under the load 3 to support the load 3 above the floor and then a first spacer block 2 is inserted into the gap between the casing 11 of the lifting mechanism 1 and the floor and secured to the bottom side of the casing 11 (see FIG. 5), and then the lifting jack is operated to move the lifting rod 13 to lift the load 3 for another lifting stroke (see FIG. 6), and then the first movable support 4 is taken away and a second movable support 4*a* is inserted under the load 3 to support the load 3 above the floor and then a second spacer block 2 is inserted into the gap between the first spacer block 2 at the bottom side of the casing 11 of the lifting mechanism 1 and the floor and secured to the bottom side of the first spacer block 2 (see FIG. 7). The aforesaid operation procedure is repeated until the load has been lifted to the desired elevation.

Referring to FIG. 1 again, the casing 11 has a plurality of mounting through holes 17 extended through the top and bottom walls. Each spacer block 2 has a plurality of mounting through holes 25 through the top and bottom walls. Through the mounting through holes 17, 25, the casing 11 and the attached spacer block(s) 2 can be affixed to the floor or the equipment below by screws.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A lifting mechanism and spacer block arrangement comprising:

a lifting mechanism installed in a lifting jack and driven to move a lifting rod vertically, the lifting mechanism including a portion of a magnetically attractive material at a bottom side;

a plurality of spacer blocks removably attachable from the lifting mechanism and each of the other spacer blocks, and configured for attaching to the bottom side of the lifting mechanism to space the lifting mechanism from a supporting surface at multiple angular orientations, the spacer blocks of a magnetically attractive material;

the spacer blocks each including:

a top side including a border configured for receiving the bottom side of the lifting mechanism within the border, such that movement of the lifting mechanism is substantially constrained;

at least one magnetic element fixedly mounted in the top side of each of the spacer blocks in a flush manner, the at least one magnetic element of a material magnetically attractive to the magnetically attractive material of the lifting mechanism and the spacer blocks; and, a bottom side including a periphery correspondingly configured with the border of the top side of each of the spacer blocks for receipt in the top side of a spacer block within the border, such that movement of the spacer block with the bottom side is substantially constrained with respect to the spacer block with the top side, and the spacer blocks are arrangable in a stack and secured to the bottom side of the lifting mechanism.

2. The lifting mechanism and spacer block arrangement as claimed in claim 1, wherein the spacer blocks each have at least one upright flange upwardly extended from the border of the respective top side, and the bottom side of each spacer block is smoothly chamfered along the periphery.

3. The lifting mechanism and spacer block arrangement as claimed in claim 1, wherein each spacer block has at least one mounting hole in the top side of the spacer block for holding the respective at least one magnetic element.

4. The lifting mechanism and spacer block arrangement as claimed in claim 1, wherein the lifting mechanism has a plurality of mounting through holes; and each spacer block comprises a plurality of mounting through holes respectively connectable to the mounting through holes of the lifting mechanism by a respective screw bolt.

5. A lifting apparatus comprising:

a casing supporting a hydraulic fluid system, the casing including a base surface of a magnetically attractive material and including an edge, the base surface configured for seating on a block in a fixed position with movement of the casing substantially constrained;

a lifting rod mounted in the casing and controlled by the hydraulic fluid system, the lifting rod arranged in the casing for extending beyond the casing during a lifting motion;

at least one block of a magnetically attractive material and configured for supporting the casing at multiple angular orientations, and including, a magnetized portion magnetically attractive to the magnetically attractive material of the base surface of the casing and the magnetically attractive material of the at least one block, and, a first side including an outwardly extending border correspondingly configured with the edge of the base surface of the casing for receiving the base surface of the casing within the outwardly extending border, such that the casing seats in a fixed position on the at least one block within the outwardly extending border, and movement of the casing on the at least one block is substantially constrained by the outwardly extending boarder coupled with the magnetic attraction between the magnetized portion and the base surface of the casing.

6. The lifting apparatus of claim 5, wherein the at least one block includes a plurality of blocks, each block of the plurality of blocks including:

a second side oppositely disposed from the first side, the second side including a periphery correspondingly configured with the first side, such that each block on the second side can seat within the outwardly extending border in a mechanical and magnetic coupling on the first side of another block of the plurality of blocks, such that movement of each block is substantially constrained.

7. The lifting apparatus of claim 6, wherein the magnetized portion of each block of the plurality of blocks includes at least one magnet.

8. A lifting apparatus comprising:

a casing, the casing including a base portion of a magnetically attractive material and including oppositely disposed peripheral edges, the base portion for seating on a correspondingly configured block in a fixed position with movement of the casing substantially constrained on the block;

a lifting system within the casing, the lifting system including a rod movable in the casing and extending from the casing during a lifting motion; and, at least one block configured for supporting the casing at multiple angular orientations, the at least one block including at least one magnetic portion, a border, and, protruding portions at least proximate to the border, the protruding portions correspondingly configured with the oppositely disposed peripheral edges of the base portion of the casing for receiving the base portion of the casing within the protruding portions, that couple with magnetic attraction forces between the base portion and the at least one block, such that movement of the casing on the at least one block is substantially constrained.

9. The lifting apparatus of claim 8, wherein the at least one block includes a plurality of blocks, each block of the plurality of blocks of a magnetically attractive material and including:

a top surface including the at least one magnetic portion and the protruding portions; and, a bottom surface including a periphery correspondingly configured with the top surface, such that the bottom surface of one block can seat within the protruding portions of the top surface of another block, and coupled with magnetic attraction forces between the top surface and the bottom surface substantially constrain movement of one block on another block of the plurality of blocks.

10. The lifting apparatus of claim 8, wherein the at least one magnetic portion includes at least one magnet that is magnetically attractive to the magnetically attractive material of the base portion of the casing.

11. The lifting apparatus of claim 9, wherein the at least one magnetic portion of each block of the plurality of blocks includes at least one magnet that is magnetically attractive to the magnetically attractive material of the base portion of the casing and to the magnetically attractive material of each block of the plurality of blocks.

12. A lifting apparatus comprising:

a casing supporting a hydraulic fluid system, the casing including at least a portion of a magnetically attractive material and peripheral edges;

a lifting rod mounted in the casing and controlled by the hydraulic fluid system, the lifting rod arranged in the casing for extending beyond the casing during a lifting motion; and, at least one magnetized block configured for supporting the casing at multiple angular orientations, the at least one magnetized block being magnetically attractive to the magnetically attractive material of the casing, the at least one magnetized block including a border and protruding flange portions at least proximate to the border correspondingly configured with the peripheral edges, for receiving at least a portion of the casing within the protruding flange portions in at least a temporary engagement, defined by a mechanical coupling and a magnetic coupling, such that movement of the casing is substantially constrained.

13. The lifting apparatus of claim 12, wherein the casing includes a base surface defining the portion of a magnetically attractive material.

14. The lifting apparatus of claim 13, wherein the at least one magnetized block includes at least one magnet.

15. The lifting apparatus of claim 14, wherein the at least one magnetized block is formed from a material magnetically attractive to the at least one magnet.

16. The lifting apparatus of claim 15 wherein the at least one magnetized block includes a plurality of interchangeable and stackable magnetized blocks, each of the blocks comprising:

a top surface including the border and the protruding flange portions correspondingly configured with the peripheral edges of the casing, and an opening for receiving the at least one magnet; and, a bottom surface oppositely disposed from the top surface, the bottom surface including a periphery correspondingly configured with the protruding flange portions of the top surface, such that one interchangeable and stackable magnetized block of the plurality of interchangeable and stackable magnetized blocks at the bottom surface seats within the protruding flange portions of the top surface and magnetically couples with the top surface of another block, with movement thereof substantially constrained.

17. A lifting apparatus comprising:

a casing supporting a hydraulic fluid system, the casing including a base portion of a magnetically attractive material, the base portion including a periphery configured for seating on a magnetized block in a fixed position with movement of the casing substantially constrained;

a lifting rod mounted in the casing and controlled by the hydraulic fluid system, the lifting rod arranged in the casing for extending beyond the casing during a lifting motion; and, at least one magnetized block configured for supporting the casing at multiple angular orientations, the at least one magnetized block including a flanged border, the flanged border correspondingly configured with the periphery of the base portion of the casing, the at least one magnetized block for receiving at least one of, the base portion of the casing or another magnetized block with a surface correspondingly configured with the flanged border, within the flanged border, in a mechanical and magnetic coupling, such that the casing or the other magnetized block seats on the at least one magnetized block, with movement of the casing or the other magnetized block substantially constrained.

18. The lifting apparatus of claim 17, wherein the at least one magnetized block includes at least one magnet.

19. The lifting apparatus of claim 18, wherein the at least one magnetized block is formed from a material magnetically attractive to the at least one magnet.

20. The lifting apparatus of claim 19, wherein the at least one magnetized block includes a plurality of interchangeable magnetized blocks, each of the interchangeable magnetized blocks comprising:

a top surface including the flanged border correspondingly configured with the periphery of the base portion of the casing, and an opening for receiving the at least one magnet; and, a bottom surface oppositely disposed from the top surface, the bottom surface including a periphery correspondingly configured with the flanged border of the top surface, such that one interchangeable magnetized block of the plurality of interchangeable magnetized blocks, at the bottom surface, seats within the flanged border of the top surface and magnetically couples with the top surface of another block, with movement thereof substantially constrained.

21. A lifting apparatus comprising:

a casing supporting a lifting system, the casing including a base portion of a magnetically attractive material, the base portion including a periphery correspondingly configured with a flanged border of a surface of a magnetized block, and, the base portion is configured for seating within the flanged border and magnetically coupling with the magnetized block to permit being supported at multiple angular orientations, when at least temporarily engaged on the magnetized block, with movement of the casing substantially constrained; and, a lifting rod mounted in the casing and controlled by the lifting system, the lifting rod arranged in the casing for extending beyond the casing during a lifting motion.

22. The lifting apparatus of claim 21, additionally comprising:

at least one magnetized block including a surface including a flanged border correspondingly configured with the periphery of the base portion of the casing, for receiving the base portion of the casing, such that the casing seats within the flanged border on the at least one magnetized block, with movement of the casing substantially constrained.

23. The lifting apparatus of claim 21, wherein the lifting system includes a hydraulic lifting system.

24. A lifting apparatus comprising:

a casing supporting a lifting system, the casing including a base surface of a magnetically attractive material, the base surface including a periphery correspondingly configured with a flanged border of a surface of a magnetized block for seating on the magnetized block within the flanged border in a temporary engagement, in a mechanical and magnetic coupling to be supported at multiple angular orientations, such that movement of the casing is substantially constrained; and, a lifting rod mounted in the casing and controlled by the lifting system, the lifting rod arranged in the casing for extending beyond the casing during a lifting motion.

25. The lifting apparatus of claim 24, additionally comprising:

at least one magnetized block including a surface including a flanged border, the flanged border correspondingly configured with the base surface of the casing for receiving the base surface of the casing within the flanged border, such that movement of the casing on the at least one magnetized block is substantially constrained.

26. The lifting apparatus of claim 24, wherein the lifting system includes a hydraulic lifting system.

27. The lifting apparatus of claim 25, wherein the at least one magnetized block is of a magnetically attractive material.

28. A lifting apparatus comprising:

a lifting mechanism installed in a lifting jack and driven to move a lifting rod vertically, the lifting mechanism including a casing, the casing including a base of a magnetically attractive material;

a plurality of spacer blocks of a magnetically attractive material and removably attachable from the lifting mechanism, the spacer blocks being stackable with respect to each other and the casing to space the lifting mechanism from a supporting surface at a plurality of angular orientations, each of the spacer blocks comprising:

a first side including an inwardly tapered periphery; and, a second side oppositely disposed from the first side, the second side including at least one magnetic portion and a flanged border correspondingly configured with the shape of the base and the inwardly tapered periphery of the first side, the second side for receiving at least one of, the base of the casing or the first side of another spacer block, within the flanged border in a magnetic coupling, with movement substantially constrained.

29. The apparatus of claim 28, wherein the flanged border of the second side of each spacer block includes oppositely disposed flanges.

30. The apparatus of claim 29, wherein the oppositely disposed flanges are tapered outward and round shaped.

31. The apparatus of claim 29, wherein the inwardly tapered periphery of the first side of each spacer block includes oppositely disposed rounded portions, corresponding to the oppositely disposed flanges.

32. The apparatus of claim 29, wherein the base of the casing includes rounded edges corresponding to the oppositely disposed flanges.

* * * * *